US006376396B1

(12) United States Patent
Thorn et al.

(10) Patent No.: US 6,376,396 B1
(45) Date of Patent: Apr. 23, 2002

(54) SOUNDPROOFING MATERIAL AND THE USE THEREOF

(75) Inventors: Udo Thorn, Netzbach; Gholam Reza Sinambari, Neustadt; Wolfgang Riediger; Georg Jochim, both of Grossmaischeid, all of (DE)

(73) Assignee: Beloh Beteiligungsgesellschaft mbH, Emsdetten (DE)

( * ) Notice: Subject to any disclaimer, the term of this patent is extended or adjusted under 35 U.S.C. 154(b) by 0 days.

(21) Appl. No.: 09/380,195

(22) PCT Filed: Feb. 9, 1998

(86) PCT No.: PCT/EP98/00686

§ 371 Date: Nov. 18, 1999

§ 102(e) Date: Nov. 18, 1999

(87) PCT Pub. No.: WO98/38370

PCT Pub. Date: Sep. 3, 1998

(30) Foreign Application Priority Data

Feb. 28, 1997 (DE) ..... 197 08 188

(51) Int. Cl.[7] ..... E04B 1/82

(52) U.S. Cl. ..... 442/136; 442/141; 442/147; 442/327; 442/402; 442/415; 428/920; 428/921; 28/107; 28/116; 181/290

(58) Field of Search ..... 442/327, 402, 442/136, 141, 147, 415; 28/107, 116; 428/920, 921; 181/290

(56) References Cited

U.S. PATENT DOCUMENTS

| | | | | |
|---|---|---|---|---|
| 3,994,363 A | * | 11/1976 | Hirao et al. | 181/33 G |
| 4,830,140 A | * | 5/1989 | Fridh et al. | 181/288 |
| 5,245,121 A | * | 9/1993 | Fortez et al. | 181/288 |
| 5,493,081 A | | 2/1996 | Manigold | 181/286 |

FOREIGN PATENT DOCUMENTS

| | | |
|---|---|---|
| DE | 195 18 285 | 11/1996 |
| EP | 0 607 946 A | 7/1994 |

* cited by examiner

*Primary Examiner*—Elizabeth M. Cole
(74) *Attorney, Agent, or Firm*—Jordan and Hamburg LLP

(57) ABSTRACT

A soundproofing material made of nonwoven materials containing thermoplastic fibers for the acoustic frequency range of 100 to 5000 Hz is characterized in that the nonwoven material is permanently compacted to a specific flow resistance of RS=800–1400 Ns/m$^3$ in two stages by a mechanical compaction process and a subsequent pressure/heat treatment.

13 Claims, 2 Drawing Sheets

SOUNDPROOFING MATERIAL AND THE USE THEREOF

BACKGROUND OF THE INVENTION

The invention relates to a soundproofing material made of nonwoven materials containing thermoplastic fibres for the acoustic frequency range of 100 to 5000 Hz. Also disclosed is a method of using the soundproofing material in secondary soundproofing.

Many acoustic problems cannot be solved satisfactorily merely by using primary soundproofing measures which are applied to a sound source, and additional secondary measures are required. Secondary measures are those which, as a rule, intervene in the transmission path of the acoustic energy. Either the energy is reflected, that is to say deflected, or the energy is converted into a different energy form, mostly heat. In the first case, insulation is used, and in the latter case, the sound is attenuated.

The prior art in conventional sound insulation uses secondary reduction measures at some distance from the source by disposing reflecting walls into the propagation path of the acoustic energy. Examples are cellular walls, partition walls or acoustic screens.

Also, in conventional sound attenuation, the prior art methods convert the acoustic energy in the medium frequency to high-frequency range into heat through the use of porous sound absorbers, wherein the extent of conversion depends on the frequency range of the sound. For example, artificial mineral fibres, open-cell foamed materials, porous inorganic bulk materials or natural fibres are used. In order to avoid abrasion of the materials, and to prevent them from escaping, they are often laminated with pourable protective materials based on a nonwoven textile.

The fact that porous absorbers are generally tried and tested only in the medium to high-frequency range is based on their physical attenuation properties. In order to attenuate an acoustic wave with the highest possible absorption, the thickness of the attenuating material must be at least one quarter of the wavelength $\lambda$ to be attenuated, since the displacement range of a sound wave is the greatest over that range. Therefore, low frequencies determine the required thickness of insulating material due to their longer wavelength. This effect can also be achieved by means of thinner material thicknesses in combination with an air gap. The insulating material is in this case arranged at a distance corresponding to $\lambda/4$. However, degree of absorption of airborne sound $\alpha$ describing the attenuation capacity is in such a configuration marked by dips in the higher-frequency range.

A significant requirement for secondary soundproofing materials, in particular in spatial acoustics, is the lowest possible insulating material thickness, in order to lose as little spatial volume as possible. In the case of these absorbers, even at a thickness of 10 cm, a distinct reduction in the absorption properties below about 800 Hz is observed. In order to achieve broadband absorption properties, even down to the low-frequency range, absorbers are used in combination with resonators which, on the basis of oscillation processes, withdraw energy over a narrow band from the acoustic wave at a resonant frequency. Their effect is primarily observed in the lower frequency range.

Since secondary soundproofing primarily concerns combating noise in the frequency range of about 200 to 4000 Hz, it is generally the case that neither porous absorbers nor resonators are on their own able to achieve efficient, broadband sound attenuation over the entire frequency range of interest. However, the possible combinations of the two types of soundproofing take up a great deal of space and are expensive.

The applications for nonwoven materials in soundproofing vary. Nonwoven materials often are used in combination with other flat materials or as supports for sound-absorbing materials. Pure nonwoven materials in needled form have been investigated for sound absorption by P. Banks-Lee, H. Peng and A. L. Diggs (TAPPI Proceedings 1992 Nonwovens Conference, pp. 209–216). It was established that, in spite of variations in various trial parameters, the nonwoven materials exhibit a sound absorption which is only insufficient for practical use in the frequency range of <1000 Hz.

EP 0 607 946 contains a description of pure nonwoven materials with thermoplastic fibres as a sound-insulating material. Table 2 of the reference shows that the absorption values in the lower frequency range are at a level which is inadequate for practical use.

SUMMARY OF THE INVENTION

The invention has the objective of providing a soundproofing material which, in addition to having a low requirement for space, exhibits a broadband absorption in the frequency range from 100 to 5000 Hz.

According to the invention, this object is achieved by a nonwoven material containing thermoplastic fibres being permanently compacted to a specific flow resistance of RS=800–1400 $Ns/m^3$ in two stages by a mechanical compaction process and a subsequent pressure/heat treatment.

DETAILED DESCRIPTION OF THE INVENTION

Figure 1:
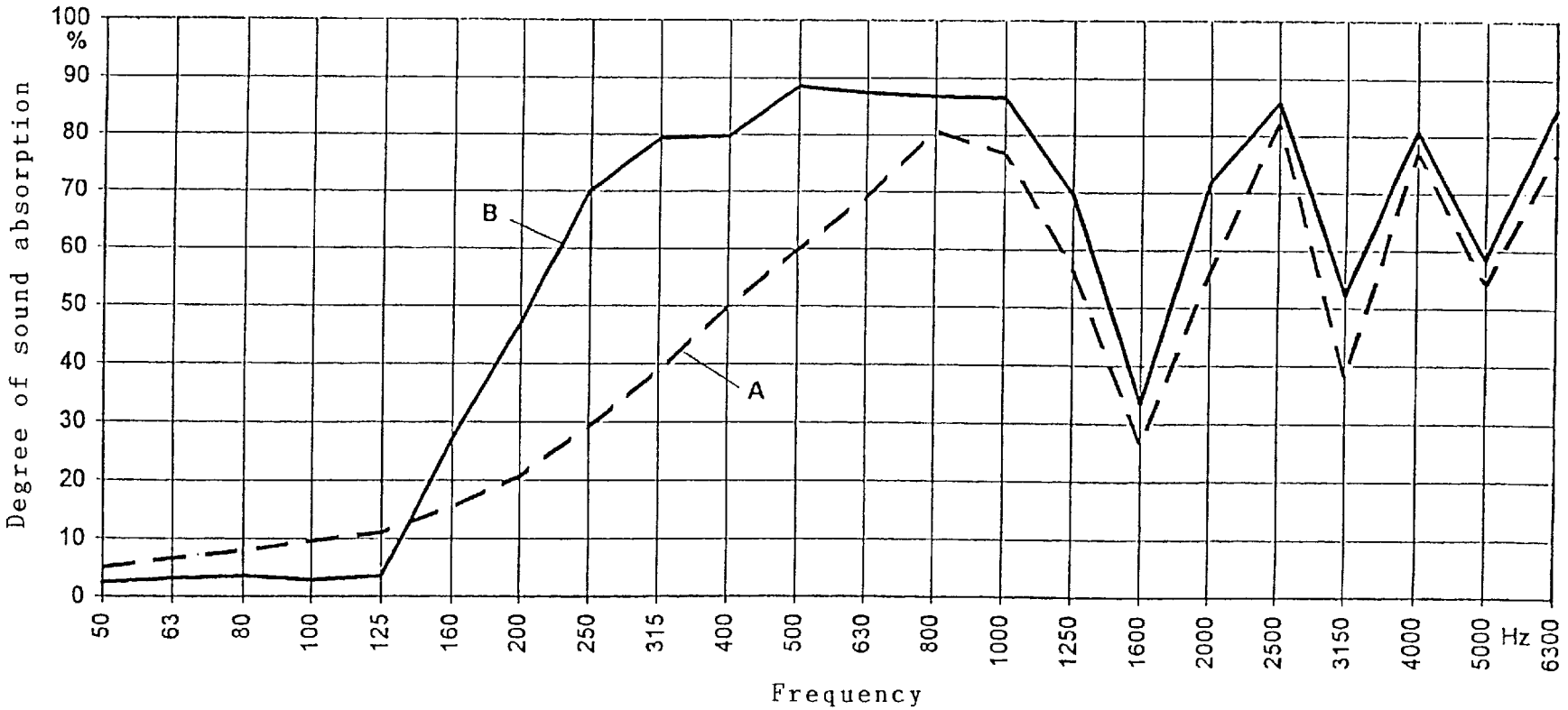
FIG. 1 is a graphical representation of a degree of sound absorption versus frequency of an embodiment of the present invention.

A surprising effect of the present invention is depicted in FIG. 1. FIG. 1 shows a graphic representation of a degree of sound absorption versus frequency for an exemplary embodiment of the present invention.

It can be seen from the overall shape of the curve (identified by B in FIG. 1), that, because of high absorption values in a low frequency range (e.g. 80% at 315 Hz), combined with absorption values of 40–85% in a higher frequency range, there is a combination of a resonator and an absorber in one material. In comparison, the overall curve shape of a nonwoven material (identified by A in FIG. 1) without subsequent pressure/heat treatment is reproduced. This curve shows the behaviour of a purely porous absorber without the supplementary resonator influenced absorption in the low frequency range.

The nonwoven material, which is suitable for the invention, is formed of natural and/or synthetic organic or inorganic primary fibres, to which 10–90% of thermoplastic secondary fibres are added. The latter have a softening range of at least 5° C., which in any case lies below any possible softening or decomposition range of the primary fibres.

The two fibre types used are those having linear densities of 0.5–17 dtex, preferably 0.9–6.7 dtex, and staple lengths of 20–80 mm, preferably 30–60 mm. The primary fibres which have been particularly tried and tested are polyethyleneterephthalate fibres in combination with copolyester fibres as secondary fibres. The primary and/or secondary fibres are optionally formed by suitable fibre mixtures. The addition of recycled fibres is of particular interest. At a density of 250 to 500 kg/m$^3$, preferably 270 to 330 kg/m$^3$, the thickness of the nonwoven materials according to the invention is 0.3 to 3.0 mm and, particularly preferably, 0.8 to 1.2 mm.

A first stage of compaction of the nonwoven material comprises a mechanical compaction, which is brought about by needling using needles with barbs, or in accordance with the spun-laced process, by means of water jets. Also, the compaction may be carried out by a stitch-bonding process by means of looping needles. Needling is particularly preferred and is carried out with 40 to 150 punctures/cm$^2$, preferably 60 to 80 punctures/cm$^2$.

A pressure/heat treatment, as a second stage of the compaction, may be configured discontinuously (cyclic) or continuously. In the first case, heated presses are suitable and, in the second case, heatable calenders. The temperature range to be selected lies within the softening range of the secondary fibres which, in turn lies below the softening or decomposition range of the primary fibres. The line pressure in calenders is in the range of 0.5 to 3.0. KN/cm, preferably 1.5 to 2.0 KN/cm.

Specific flow resistance of the compacted nonwoven materials is particularly significant, since it is directly correlated with the degree of sound absorption. Specific flow resistance values of RS=800–1400 Ns/m$^3$, and particularly those of 1100±150 Ns/m$^3$ have proven to be useful. Following the first compaction stage, the specific flow resistance values are approximately one fifth of these values.

The nonwoven materials according to the present invention are optionally laminates and/or other two-dimensional structures. For special purposes, fibres are used which have had a colorant and/or flameproofing agent and/or electrically conductive components added to them as early as during the production process. In addition, there is a possibility of finishing the finished nonwoven material by making the nonwoven material flame-retardant, using, for example metal hydroxides and/or ammonium polyphosphate and/or melamine and/or red phosphorus. Also, the nonwoven material may be dyed and antioxidation agents and/or antistatic agents may be added.

The invention is explained in more detail below in an exemplary embodiment of the invention. Using a card, a nonwoven material with a uniform weight per unit area is produced from a homogeneous mixture of 50% by weight of 1.7/38 PES fibres (dtex/staple length) and 50% by weight of 2.2/50 COPES fibres. After being processed through a carding and transverse-laying device, the nonwoven material has a weight per unit area of about 300 g/m$^2$. The nonwoven material is lightly needled with two needling passes of 40 to 150 punctures/cm$^2$ in each case, and is compacted by a pair of smooth rollers heated to approximately 135° C. and a line pressure of about 1.7 KN/cm. This nonwoven material, produced in this way, has a specific flow resistance of about RS=1100 Ns/m$^3$.

The way in which the degree of sound absorption depends on the frequency is illustrated graphically in FIG. 1. Curve A refers to the nonwoven material following the first compaction stage, and curve B refers to the final product of the present invention.

Figure 2:
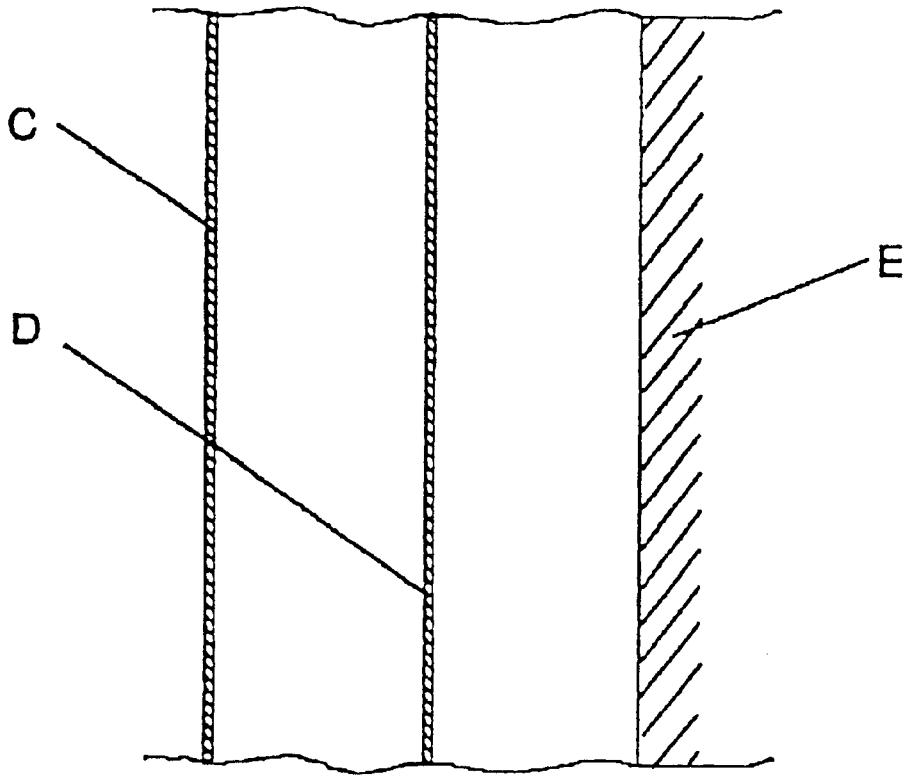
FIG. 2 is an illustration of a three-dimensional arrangement of a soundproofing material of the present invention.

FIG. 2 shows a schematic illustration of a three-dimensional arrangement of the soundproofing material of the present invention. A broadband sound absorption effect of the material is achieved by combining resonator and porous absorption mechanisms at the same time in unified form in the nonwoven material according to the invention, in conjunction with an air gap whose width depends on the lowest frequency to be countered. The air gap is behind the nonwoven material layer C according to the present invention. FIG. 2 shows, by way of example, an arrangement of the nonwoven material layer C in front of a reflective wall element E. Dips in the degree of absorption in the frequency range of interest are optionally avoided by adding further nonwoven material layers of the material layer D according to the invention.

The nonwoven materials according to the invention can be used primarily in the area of secondary soundproofing indoors, for example, as an acoustically effective layer in soundproofing cabinet walls and screens or as an acoustically effective layer in suspended ceiling constructions (acoustic ceilings). They are distinguished by a dual function, since they intrinsically unify resonance and absorption effects. It therefore becomes possible to achieve a broadband sound absorption, even in the low acoustic frequency range, using only one material.

The following test methods set forth below were performed on the present invention. The degree of absorption of airborne sound was measured according to DIN 52 215 (Determination of the degree of sound absorption and of the impedance in a pipe). The airborne sound absorption values in FIG. 1 were measured in accordance with the above-mentioned method. The specific flow resistance was measured according to DIN EN 29053, method B. Commercially available thickness measuring instruments using sensor surfaces of 20 cm$^2$, a contact pressure of 10 cN/cm$^2$ and an action time of 5 seconds were used to measure thickness.

What is claimed is:

1. Soundproofing material for the acoustic frequency range of 100 to 5000 Hz comprising a nonwoven material containing thermoplastic fibres wherein the nonwoven material is permanently compacted to a specific flow resistance of Rs=800–1400 Ns/m$^3$ in two stages by a mechanical compaction process and a subsequent pressure/heat treatment.

2. The soundproofing material of claim 1 wherein the nonwoven material comprises primary fibres and 10–90% by weight thermoplastic secondary fibres having a softening range of at least 5° C.

3. The soundproofing material of claim 2 wherein the primary and secondary fibres are those having linear densities of 0.5 to 17 to dtex and staple lengths of 20 to 80 mm.

4. The soundproofing material of claim 2 wherein the primary fibres are polyethyleneterephthalate fibres and the secondary fibres are copolyester fibres.

5. The soundproofing material of claim 1 wherein the nonwoven material has a thickness of 0.3 to 3.0. mm and a density of 250 to 500 kg/m$^3$.

6. The soundproofing material of claim 1 wherein the first stage of the compaction of the nonwoven material is implemented by a needling process.

7. The soundproofing material of claim 1 wherein the second stage of compaction is implemented within the softening range of the secondary fibres at line pressures of 0.5 to 3.0. KN/cm.

8. The soundproofing material of claim 1 wherein the compacted nonwoven material has a specific flow resistance of 1100±150 Ns/m$^3$.

9. The soundproofing material of claim 1 wherein the nonwoven material has a flame-retardant finish resulting from application thereto of a composition comprising at least one of metal hydroxides, ammonium polyphosphates, melamine and red phosphorous.

10. A method of achieving a broadband sound-absorbing effect for indoor soundproofing by a combination of resonator and porous absorption mechanisms, comprising providing a layer of a soundproofing material according to any one of claims 1 to 9 in conjunction with an air gap whose width depends on the lowest frequency to be countered, said air gap being behind the layer of the soundproofing material.

11. The method of claim 10, further comprising providing at least one additional layer of the soundproofing material spaced from the other layer, whereby dips in the degree of absorption in the frequency range of interest are avoided.

12. A method for secondary soundproofing indoors comprising covering a surface with a soundproofing material according to any one of claims 1 to 9.

13. A method of making soundproofing material for the acoustic frequency range of 100 to 5000 Hz comprising permanently compacting a nonwoven material comprising thermoplastic fibers to a specific flow resistance Rs=800–1400 $Ns/m^3$ by first mechanically compacting the nonwoven material and then subjecting the mechanically compacted nonwoven material to a combination of pressure and heat.

* * * * *